US006571954B2

(12) United States Patent
Nadler

(10) Patent No.: US 6,571,954 B2
(45) Date of Patent: Jun. 3, 2003

(54) INFLATABLE PACKAGING SYSTEM

(75) Inventor: Thomas I. Nadler, West Orange, NJ (US)

(73) Assignee: Experience Design LLC, Garfield, NJ (US)

( * ) Notice: Subject to any disclaimer, the term of this patent is extended or adjusted under 35 U.S.C. 154(b) by 0 days.

(21) Appl. No.: 09/901,545

(22) Filed: Jul. 9, 2001

(65) Prior Publication Data

US 2003/0024846 A1 Feb. 6, 2003

(51) Int. Cl.[7] ..... B65D 81/03
(52) U.S. Cl. ..... 206/522; 383/3
(58) Field of Search ..... 206/522, 521, 206/591, 594; 383/3

(56) References Cited

U.S. PATENT DOCUMENTS 3,523,563 A * 8/1970 Mirando ..... 137/227
4,155,453 A * 5/1979 Ono ..... 206/522
4,190,158 A * 2/1980 Ambrose ..... 206/522
4,872,558 A 10/1989 Pharo
4,874,093 A 10/1989 Pharo
4,918,904 A 4/1990 Pharo
4,949,530 A 8/1990 Pharo
5,272,856 A 12/1993 Pharo
5,316,386 A * 5/1994 Moore ..... 184/1.5
5,447,235 A 9/1995 Pharo
5,487,470 A * 1/1996 Pharo ..... 206/521
5,588,532 A * 12/1996 Pharo ..... 206/522
5,711,691 A 1/1998 Demask et al.
6,283,296 B1 * 9/2001 Newman ..... 206/522

* cited by examiner

*Primary Examiner*—David T. Fidei
(74) *Attorney, Agent, or Firm*—Kirschstein, et al.

(57) ABSTRACT

A packaging system for protecting an article during shipment includes a larger outer bag, a smaller inner bag, and an inlet between the bags for inflating a pair of chambers situated on opposite sides of the article via a bypass passage that extends around the inner bag.

15 Claims, 5 Drawing Sheets

FIG. 11
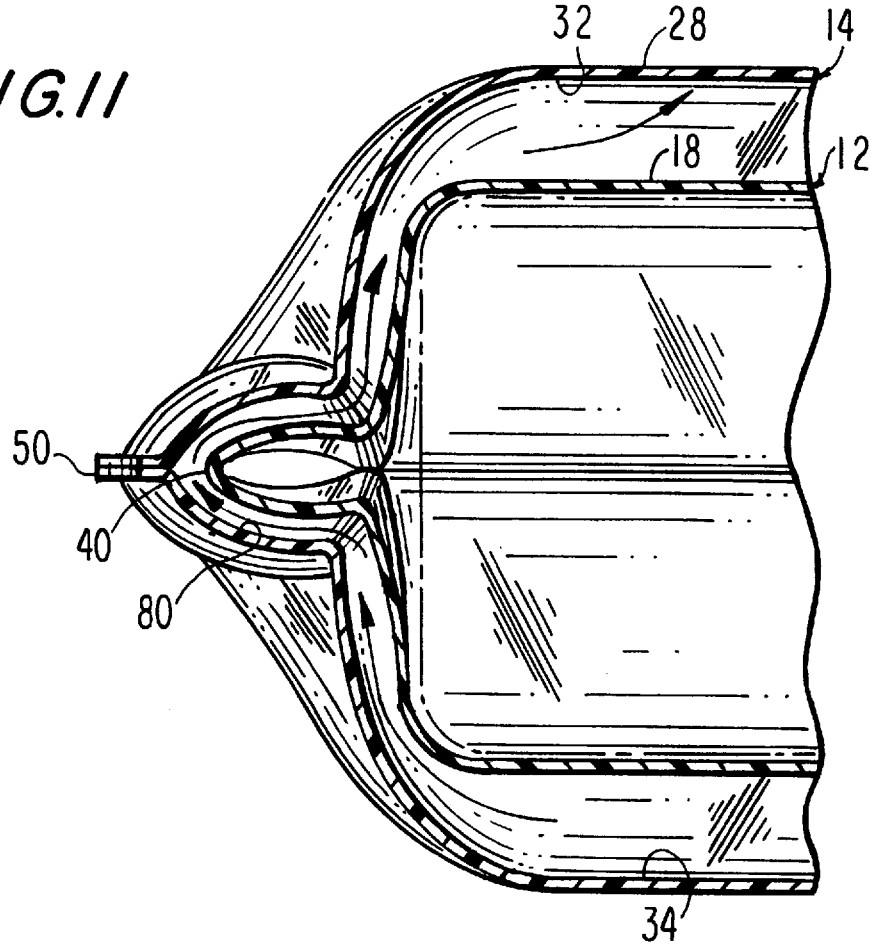
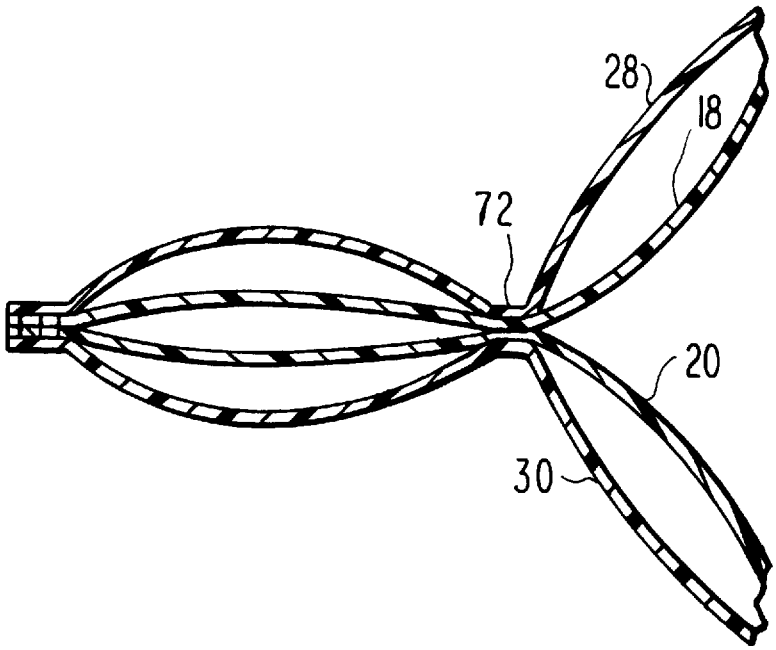
FIG. 12

INFLATABLE PACKAGING SYSTEM

BACKGROUND OF THE INVENTION

1. Field of the Invention

The present invention generally relates to an inflatable packaging system for protecting an article during shipment and, more particularly, to a leak-resistant system for reliably protecting the article even during rough handling.

2. Description of the Related Art

It is generally known from U.S. Pat. No. 4,872,558; No. 4,874,093; No. 4,918,904; No. 4,949,530; No. 5,272,856; No. 5,447,235; No. 5,487,470; No. 5,588,532 and No. 5,711,691 to form an inflated wrapping around an article to be shipped in order to cushion and protect the article during shipment. As advantageous as such inflated wrappings are, experience has shown that there is a need for inflatable packaging systems that can reliably retain a packaged article even during rough handling.

SUMMARY OF THE INVENTION

OBJECTS OF THE INVENTION

Accordingly, it is a general object of this invention to provide a leak-resistant, inflatable packaging system that reliably cushions and protects an article to be shipped.

More particularly, it is an object of the present invention to provide a pouch that is easy to inflate, that resists leakage, and that is economical in manufacture.

FEATURES OF THE INVENTION

In keeping with the above objects and others which will become apparent hereinafter, one feature of the present invention resides, briefly stated, in an inflatable packaging system that comprises an inner bag smaller than, and located within, an outer bag, together with an inflation inlet between the two bags.

More particularly, the inner bag has an open end, a closed end, and first and second inner bag wall portions overlying each other and bounding a pocket for receiving the article through the open end. The outer bag exteriorly surrounds, and is sealed to, the inner bag. The outer bag has a first outer bag wall portion overlying the first inner bag wall portion and bounding therewith a first inflatable chamber at one exterior side of the pocket, and a second outer bag wall portion overlying the second inner bag wall portion and bounding therewith a second inflatable chamber at an opposite exterior side of the pocket.

In accordance with this invention, the first and second outer bag wall portions of the larger outer bag extend respectively past the first and second inner bag wall portions of the smaller inner bag. The larger outer wall portions bound a bypass passage with the smaller inner wall portions. This bypass passage is in fluid flow communication with both of the inflatable chambers. The inflation inlet, which is adjacent the open end, inflates both chambers from a deflated condition via the bypass passage, and retains the article in the pocket between the chambers in an inflated condition.

In one embodiment, the inner bag has a pair of outer corner edges spaced from, and bounding the bypass passage with, a pair of corner regions of the outer bag. In another embodiment, the closed end of the inner bag is spaced from, and bounds the bypass passage with, a closed end region of the outer bag. In both embodiments, the bypass passage does not extend through the inner bag wall portions, but instead, extends around the inner bag. This feature does not degrade the structural integrity of the inner bag and contributes to a system that is better able to withstand leaks, especially during rough handling during shipment.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 11 is an enlarged sectional view taken on line 11—11 of FIG. 9; and FIG. 12 is an enlarged sectional view taken on line 12—12 of FIG. 9.

DETAILED DESCRIPTION OF THE PREFERRED EMBODIMENTS

Figures 1, 2, 3:
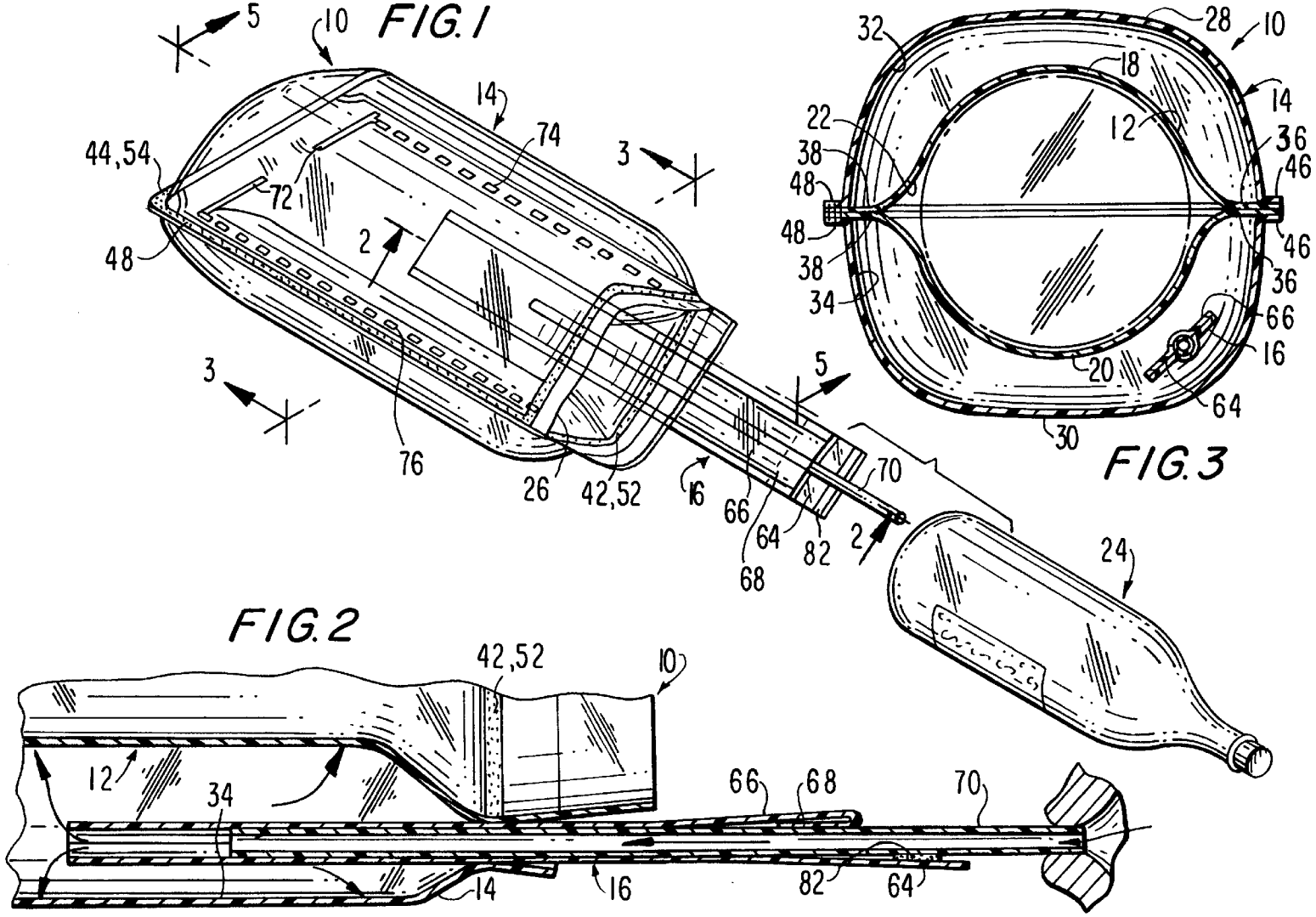
FIG. 1 is a perspective view of one embodiment of a packaging system according to this invention depicting insertion of an article to be protected.
FIG. 2 is a sectional view taken on line 2—2 of FIG. 1.
FIG. 3 is a sectional view taken on line 3—3 of FIG. 1.
Figure 4:
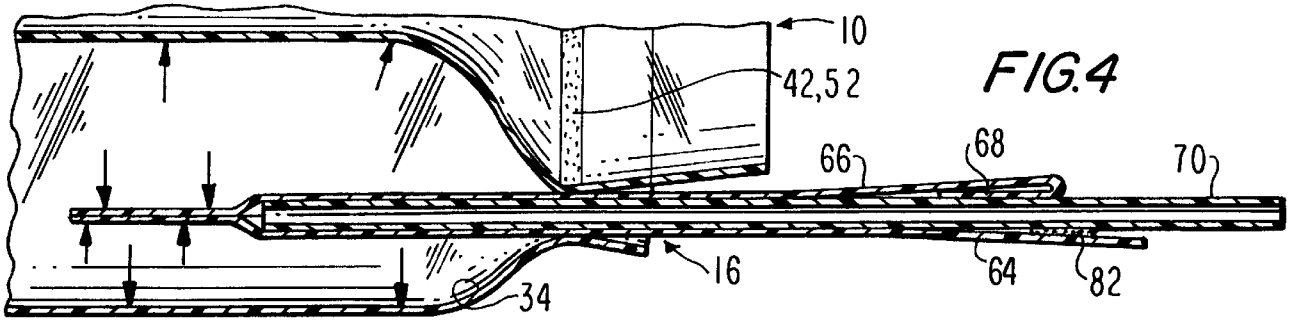
FIG. 4 is a view analogous to FIG. 3 after inflation.
Figure 5:
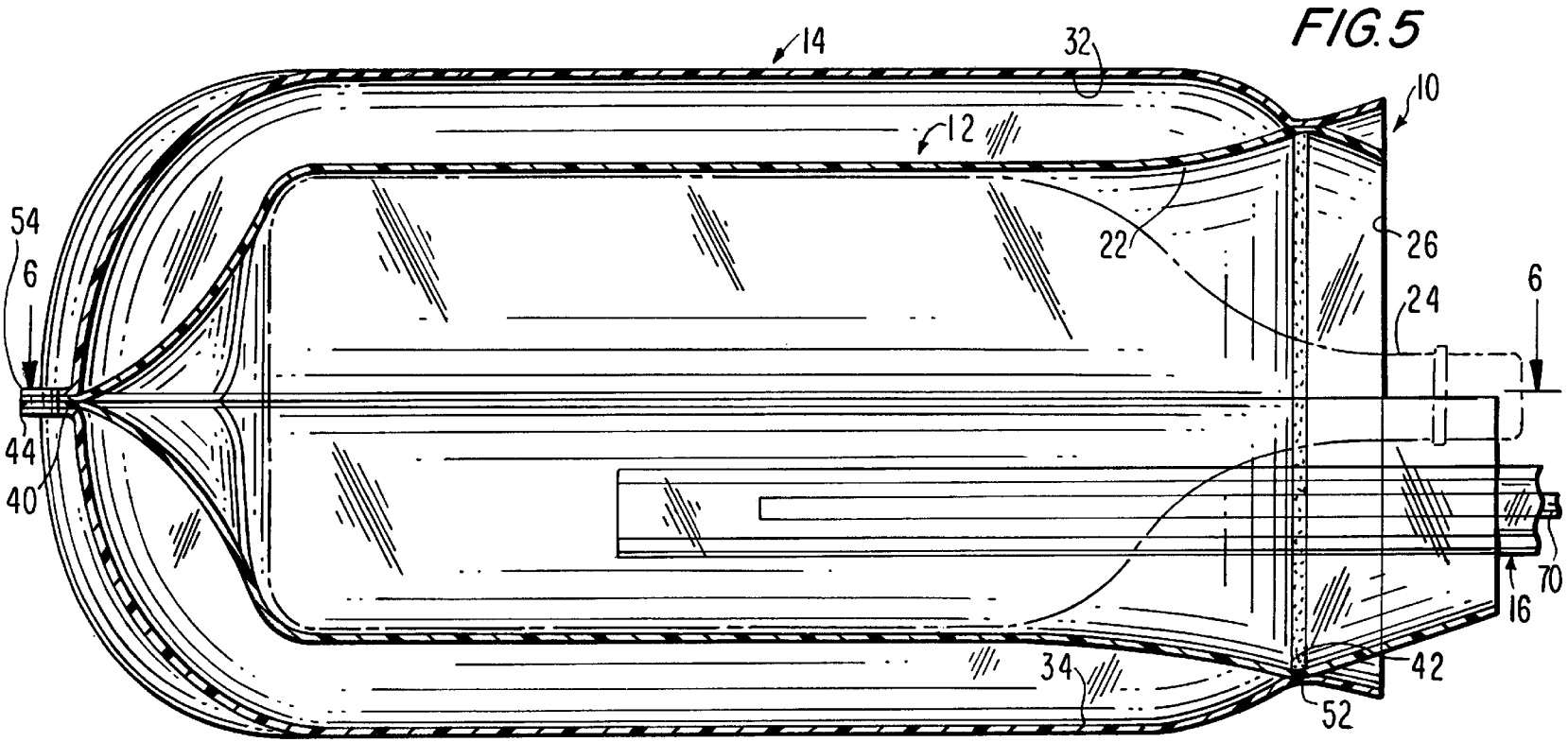
FIG. 5 is a sectional view taken on line 5—5 of FIG. 1.
Figure 6:
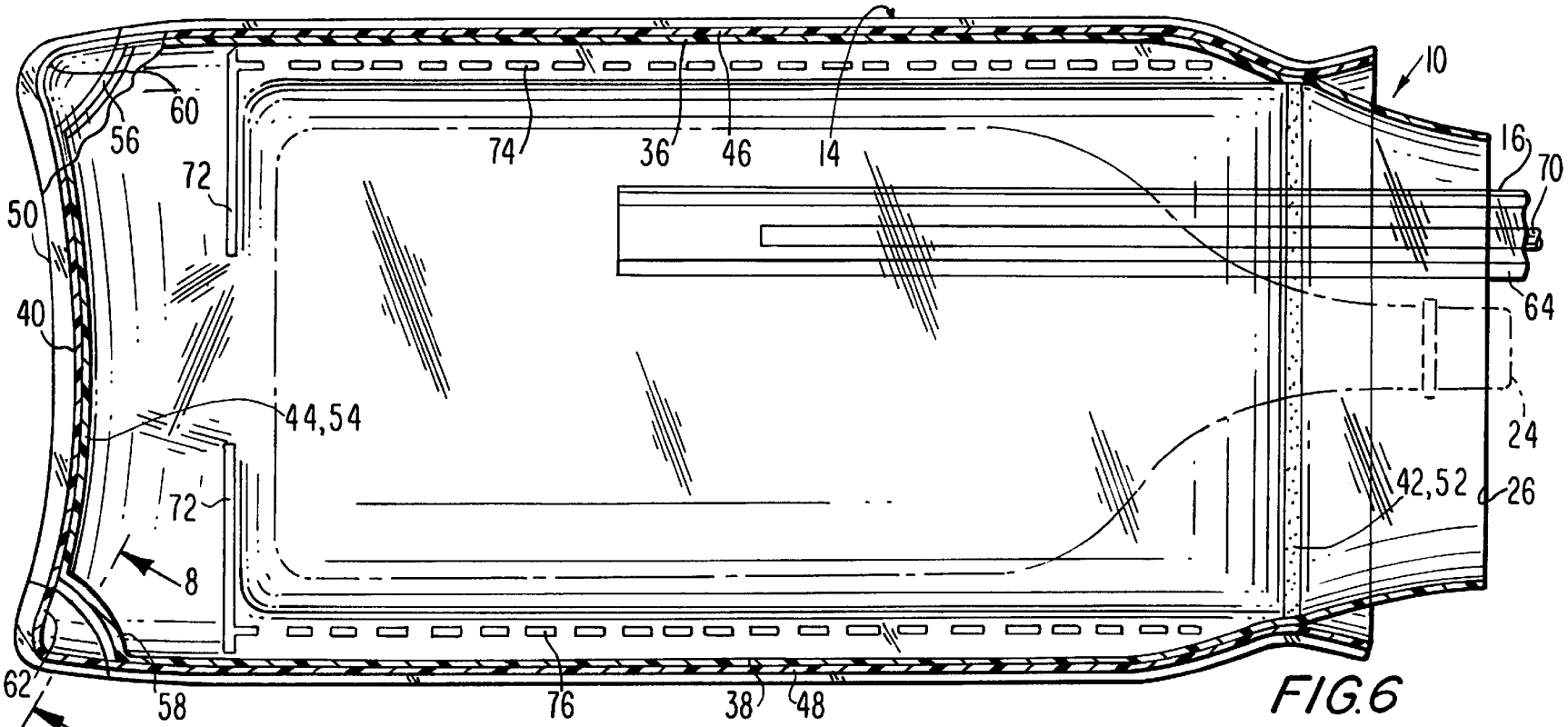
FIG. 6 is a sectional view taken on line 6—6 of FIG. 5.
Figure 7:
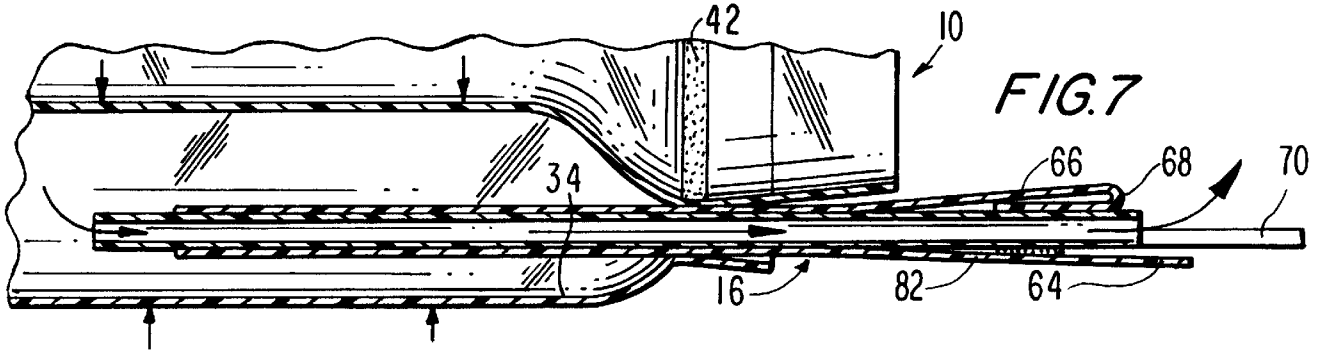
FIG. 7 is a sectional view analogous to FIG. 3 during deflation.
Figure 8:
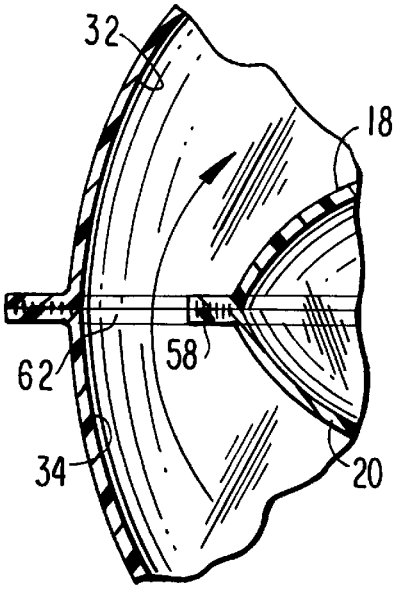
FIG. 8 is a sectional view taken on line 8—8 of FIG. 6.

Reference numeral 10 in FIGS. 1–7 generally identifies a first embodiment of an inflatable packaging system according to this invention. As best seen in FIG. 3, system 10 includes an inner bag 12, an outer bag 14, and an inflation inlet 16 situated between the bags 12, 14. Inner bag 12 has first 18 and second 20 inner bag wall portions overlying each other and bounding a pocket 22 for receiving an article 24 through an open end 26 of the inner bag 12. Outer bag 14 has first 28 and second 30 outer bag wall portions respectively overlying the first 18 and second 20 inner bag wall portions and respectively bounding first 32 and second 34 inflatable chambers located at opposite exterior sides of the pocket. As explained below, when inflated via the inlet 16, the chambers 32, 34 resiliently bear against, and firmly retain, the article 24 therebetween within the pocket 22.

Each wall portion is constituted of a gas-impermeable, flexible material, preferably a plastic sheet material that is capable of being heat-sealed and bonded to an overlying plastic sheet material. Laminates of polyethylene, a metallized nylon, Mylar™ are suitable. The composite thickness of each wall portion lies in a range from about one to about ten mils.

Each bag 12, 14 can be made by heat-sealing a plurality of longitudinal and transverse, outer peripheral edges of generally rectangular sheets constituting the wall portions of the respective bag. Rather than individual sheets, the first and second wall portions of either the inner bag or the outer bag can be formed from a single, folded-over sheet. Alternatively, each bag can be extruded or formed as a tubular sleeve, and pressed flat to form the overlying wall portions of each bag.

Rectangular inner bag 12 has longitudinal edges 36, 38 aligned with, and heat-sealed to, longitudinal edges 46, 48 of the rectangular outer bag 14. Inner bag 12 has a closed end 40 opposite to the open end 26. Inner bag 12 also has transverse edges 42, 44 aligned with transverse edges 52, 54 of the outer bag 14. Transverse edges 42, 52 are heat-sealed together. Transverse edges 44, 54 are heat-sealed together. Transverse edges 52, 54 are heat-sealed together to form a closed end 50 for the outer bag.

In the embodiment of FIGS. 1–8, the closed ends 40, 50 of the inner and outer bags are heat-sealed together. A pair of outer rounded corner seams 56, 58, (see FIG. 6) each extending along a quarter-circular arc of 90°, is provided at opposite corners of each of the first and second inner bag wall portions 18, 20 at the closed end 40 of the inner bag. The seams 56 on wall portions 18, 20 overlie and are heat-sealed together. The seams 58 on wall portions 18, 20 overlie and are heat-sealed together. The seams 56, 58 bound with opposite corner regions of the outer bag 14 a pair of bypass passages 60, 62 that are in fluid flow communication with both of the inflatable chambers 32, 34. Each bypass passage has a cross-section shaped as a quarter-circle, but other cross-sectional shapes are contemplated.

The inlet 16 includes two strips 64, 66, preferably of the same material as the bags, having their longitudinal edges heat-sealed together to create a tubular passage. One of the strips is folded over to form a one-way valve 68. The strips 64, 66 are heat-sealed in position between one of the outer wall portions and one of the inner wall portions. The inlet 16 extends from the exterior of both bags into one of the inflatable chambers within the system.

Inflation is obtained by inserting a tube 70 through the tubular passage of the inlet and forcing a fluid, such as air, carbon dioxide, helium, or other gas, through the tube. Human lung power can be used, or, preferably, an inflation apparatus is used to admit the air under pressure via the tube initially into one of the inflatable chambers, and thereupon to flow into the other of the inflatable chambers via the bypass passages 60, 62. The inflated chambers effectively encapsulate and suspend the article between the inner wall portions 18, 20 of the inner bag due to the air pressure within the chambers. The article is held securely against rotation and shifting, and even from removal through the open end 26.

In the example depicted, the article is a glass bottle containing a beverage. Any article to be shipped can be protected by the system of this invention. Despite the irregular contour of the depicted article, the compressive forces exerted by the chambers on the article distribute themselves inwardly and uniformly around the outer contour of the article.

A heat-sealed transverse abutment seam 72 comprised of one or more bonded areas extends transversely across the bags at a distance from the closed end 40 and limits how far the article can be inserted into the pocket. Seam 72 preferably bonds overlying areas of the inner wall portions 18, 20 and the outer wall portions 28, 30 and maintains the article away from the closed end 40.

A pair of heat-sealed, longitudinal seams 74, 76 comprised of one or more bonded areas extends longitudinally along the inner bag at a distance from the longitudinal edges 36, 38. Seams 74, 76 maintains the article away from the sealed longitudinal edges 36, 38. Together, the seams 72, 74, 76 serve to more centrally locate the article within the system and to resist rupture at the closed end 40 and at the longitudinal edges 36, 38, especially during rough handling.

Once inflated, the tube 70 is withdrawn from the inlet. The pressure of the air within the chambers presses the strips 64, 66 together to flatten the inlet and resist the escape of air to the exterior of the system. The valve 68 is also pressed flat against the inlet to further resist against leakage. If desired, a heat seal can be formed across the inlet to permanently seal the system closed.

To deflate the system, one can puncture one of the chambers with a sharp tool, or insert a tube back into the inlet and squeeze the air within the chambers out through the tube.

Figure 9:
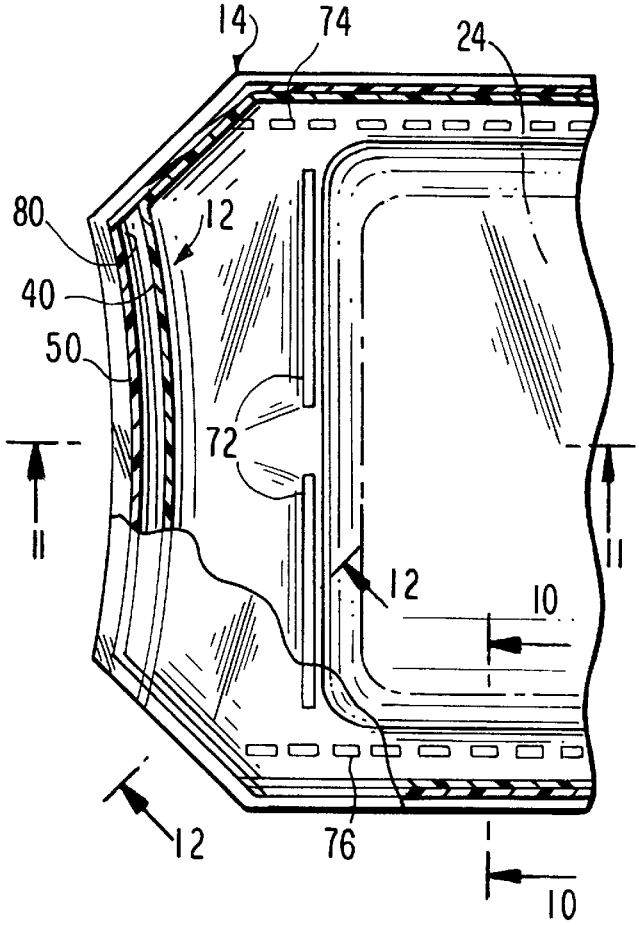
FIG. 9 is a part sectional, part broken-away view of a closed end region of another embodiment of a packaging system according to this invention.
Figure 10:
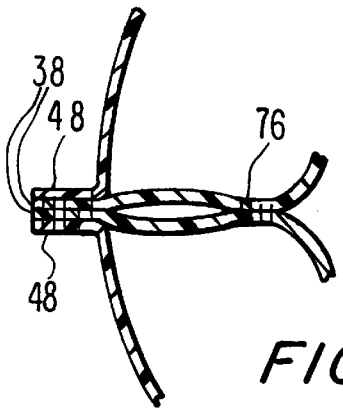
FIG. 10 is an enlarged sectional view taken on line 10—10 of FIG. 9.

FIGS. 9–12 depict another embodiment of a packaging system in which the bypass passage also does not extend through inner bag wall portions, but instead, extends around the inner bag. Using the same reference numerals as in the first embodiment, FIG. 9 depicts the closed end 40 of the inner bag 12 spaced from, and bounding a bypass passage 80 with, the closed end region 50 of the outer bag 14. The bypass passage 80 extends transversely across the closed end region 50 as opposed to the bypass passages 60, 62 of the first embodiment which are present only at the corners of the outer bag. The flow of air from the inflatable chamber 34 through the bypass passage 80 into the inflatable chamber 32 is depicted by arrows in FIG. 11.

Returning to FIG. 1, a pressure-sensitive adhesive layer 82 is applied over strip 64 of the inlet adjacent its outermost free end. Once the system is inflated, the inlet 16 is folded over the open end 26 and pressed against the outer bag, thereby effecting a mechanical closure. A peel-off protective strip (not illustrated) normally overlies the adhesive layer prior to and during inflation, but is peelably removed to expose the adhesive prior to folding the inlet over the open end 26.

It will be understood that each of the elements described above, or two or more together, also may find a useful application in other types of constructions differing from the types described above.

While the invention has been illustrated and described as embodied in a inflatable packaging system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. An inflatable packaging system for protecting an article, comprising:

a) an inner bag having an open end, first and second inner bag wall portions overlying each other and bounding a pocket for receiving the article through the open end, a closed end opposite the open end, longitudinal outer edges extending between the closed and open ends along a longitudinal direction, transverse outer edges extending between the longitudinal outer edges along a transverse direction generally perpendicular to the longitudinal direction, and an outer corner edge;

b) an outer bag exteriorly surrounding and sealed to the inner bag along the longitudinal outer edges, the outer bag having a first outer bag wall portion overlying the first inner bag wall portion and bounding therewith a first inflatable chamber at one exterior side of the pocket, and a second outer bag wall portion overlying the second inner bag wall portion and bounding therewith a second inflatable chamber at an opposite exterior side of the pocket, the first and second outer bag wall portions extending respectively past, and bounding with, the first and second inner bag wall portions a bypass passage in fluid flow communication with both of the chambers, the outer bag having a closed end region extending along the transverse direction and sealed to the closed end of the inner bag, the closed end region of the outer bag being spaced from the outer corner edge of the inner bag to bound the bypass passage; and c) an inflation inlet situated between the bags adjacent the open end, for inflating both chambers from a deflated condition via the bypass passage, and for retaining the article in the pocket between the chambers in an inflated condition.

2. The system of claim 1, wherein the bags are constituted of a gas-impermeable, flexible material.

3. The system of claim 1, wherein the first and second inner bag wall portions are respectively sealed to the first and second outer bag wall portions along a pair of the transverse outer edges at the open end.

4. The system of claim 1; and further comprising an abutment extending at least partly along the transverse direction across the pocket away from the open end, for engaging the article in the pocket.

5. The system of claim 1, wherein the inlet is a flat valve extending past the open end, and being foldable over the open end to close the pocket.

6. The system of claim 5, wherein the valve has an adhesive to adhere to the outer bag after folding.

7. The system of claim 1, wherein each bag wall portion is generally rectangular in the deflated condition.

8. An inflatable packaging system for protecting an article, comprising:

a) an inner bag having an open end, and first and second inner bag wall portions overlying each other and bounding a pocket for receiving the article through the open end;

b) an outer bag exteriorly surrounding and sealed to the inner bag, the outer bag having a first outer bag wall portion overlying the first inner bag wall portion and bounding therewith a first inflatable chamber at one exterior side of the pocket, and a second outer bag wall portion overlying the second inner bag wall portion and bounding therewith a second inflatable chamber at an opposite exterior side of the pocket, the first and second outer bag wall portions extending respectively past, and bounding with, the first and second inner bag wall portions a bypass passage in fluid flow communication with both of the chambers; and c) an inflation inlet situated between the bags adjacent the open end, for inflating both chambers from a deflated condition via the bypass passage, and for retaining the article in the pocket between the chambers in an inflated condition, the inlet including a flat valve extending past the open end and being foldable over the open end to close the pocket, the valve having an adhesive to adhere the valve to the outer bag after folding.

9. A The system of claim 8, wherein the bags are constituted of a gas-impermeable, flexible material.

10. The system of claim 8, wherein the inner bag has a closed end opposite the open end, and longitudinal outer edges extending between the closed and open ends along a longitudinal direction, and transverse outer edges extending between the longitudinal outer edges along a transverse direction generally perpendicular to the longitudinal direction; and wherein the outer bag is sealed to the inner bag along the longitudinal outer edges.

11. The system of claim 10, wherein the first and second inner bag wall portions are respectively sealed to the first and second outer bag wall portions along a pair of the transverse outer edges at the open end.

12. The system of claim 10, wherein the outer bag has a closed end region extending along the transverse direction, and wherein the closed end of the inner bag is spaced away from the closed end region to bound said bypass passage.

13. The system of claim 10, wherein the outer bag has a closed end region extending along the transverse direction, and wherein the closed end region is sealed to the closed end of the inner bag; and wherein the inner bag has an outer corner edge spaced from the closed end region of the outer bag to bound said bypass passage.

14. The system of claim 10; and further comprising an abutment extending at least partly along the transverse direction across the pocket away from the open end, for engaging the article in the pocket.

15. The system of claim 8, wherein each bag wall portion is generally rectangular in the deflated condition.

* * * * *